US008747221B2

(12) United States Patent
Cramer et al.

(10) Patent No.: US 8,747,221 B2
(45) Date of Patent: Jun. 10, 2014

(54) SERVICE CONTROLLER FOR SERVICING WAGERING GAME MACHINES

(75) Inventors: Steven R Cramer, Mundelein, IL (US); Grover T. Surratt, Winfield, IL (US); Alfred Thomas, Las Vegas, NV (US)

(73) Assignee: WMS Gaming Inc., Waukegan, IL (US)

( * ) Notice: Subject to any disclaimer, the term of this patent is extended or adjusted under 35 U.S.C. 154(b) by 298 days.

(21) Appl. No.: 13/295,909

(22) Filed: Nov. 14, 2011

(65) Prior Publication Data

US 2012/0115582 A1 May 10, 2012

Related U.S. Application Data

(63) Continuation of application No. 12/293,371, filed as application No. PCT/US2007/006696 on Mar. 16, 2007, now Pat. No. 8,075,397.

(60) Provisional application No. 60/743,521, filed on Mar. 17, 2006.

(51) Int. Cl.
*G07F 17/32* (2006.01)

(52) U.S. Cl.
USPC ..... 463/29; 463/16; 463/20; 463/25

(58) Field of Classification Search
USPC ..... 463/16, 20, 25, 29, 42
See application file for complete search history.

(56) References Cited

U.S. PATENT DOCUMENTS 4,856,787 A * 8/1989 Itkis ..... 273/237
5,655,966 A 8/1997 Werdin, Jr. et al.
6,383,076 B1 5/2002 Tiedeken
2004/0229684 A1* 11/2004 Blackburn et al. ..... 463/29
2009/0197660 A1 8/2009 Cramer et al.

FOREIGN PATENT DOCUMENTS

WO WO-2007109168 A2 9/2007
WO WO-2007109168 A3 9/2007

OTHER PUBLICATIONS

"U.S. Appl. No. 12/293,371, Non Final Office Action mailed Mar. 9, 2011", 9 pgs.
"U.S. Appl. No. 12/293,371, Notice of Allowance mailed Aug. 4, 2011", 10 pgs.
"U.S. Appl. No. 12/293,371, Response filed May 31, 2011 to Non Final Office Action mailed Mar. 9, 2011", 12 pgs.
"International Application Serial No. PCT/US2007/006696, International Preliminary Examination Report mailed Oct. 7, 2008", 6 pgs.
"International Application Serial No. PCT/US2007/006696, International Search Report mailed May 28, 2008", p. 220, 4 pgs.
"International Application Serial No. PCT/US2007/006696, International Written Opinion mailed May 28, 2008", p. 237, 4 pgs.

* cited by examiner

*Primary Examiner* — Omkar Deodhar
(74) *Attorney, Agent, or Firm* — Nixon Peabody LLP

(57) ABSTRACT

Methods and apparatus for servicing wagering game machines are described herein. In one embodiment, the method includes receiving, over a wagering game network, service information originating from a wagering game machine, wherein the wagering game machine is configured to receive a wager associated with a wagering game. The method can also include, based on the service information and a service plan associated with the wagering game machine, determining a service action. The method can also include performing the service action.

26 Claims, 10 Drawing Sheets

SERVICE CONTROLLER FOR SERVICING WAGERING GAME MACHINES

RELATED APPLICATION

This patent application is a continuation of U.S. patent application Ser. No. 12/293,371, filed Feb. 12, 2009, now issued as U.S. Pat. No. 8,075,397, which is a U.S. National Stage Filing under 35 U.S.C. 371 from International Patent Application Serial No. PCT/US2007/006696, filed Mar. 16, 2007, and published on Sep. 27, 2007, as WO 2007/109168 A2 and republished as WO 2007/109168 A3, which claims the priority benefit of U.S. Provisional Patent Application Ser. No. 60/743,521 filed Mar. 17, 2006 and entitled "SERVICE CONTROLLER FOR SERVICING WAGERING GAME MACHINES", the contents of which are incorporated herein by reference in their entireties.

LIMITED COPYRIGHT WAIVER

A portion of the disclosure of this patent document contains material to which the claim of copyright protection is made. The copyright owner has no objection to the facsimile reproduction by any person of the patent document or the patent disclosure, as it appears in the U.S. Patent and Trademark Office file or records, but reserves all other rights whatsoever. Copyright 2006, 2007, WMS Gaming, Inc.

FIELD

This invention relates generally to the field of wagering game machines and more particularly to the field of troubleshooting and servicing wagering game machines.

BACKGROUND

A wide variety of computerized wagering game machines are now available to casino operators and players. Computerized wagering game machines range from slot machines to games that are traditionally played live, such as poker, blackjack, roulette, etc. These wagering game machines provide many benefits to game owners and players, including increased reliability over mechanical machines, greater game variety, improved sound and animation, and lower overall management cost.

When technicians initially deploy wagering game machines for use in casinos, they typically manually wire the machines into wagering game networks and manually configure numerous settings. For example, the technicians may configure settings such as currency denominations for bill validators, screen resolution for video displays, volume for an audio devices, etc. Technicians often configure gaming machine settings by toggling DIP switches, moving expansion board jumpers, setting various dials and knobs, and paging through complicated set-up menus.

After deploying the wagering game machines into operation, technicians typically expend considerable efforts maintaining and repairing the machines. Technicians often utilize a variety of resources, such as service manuals and schematics, to facilitate the maintenance/repair process. However, despite these resources, even the most experienced technicians have difficulties maintaining and repairing wagering game machines in the field. Additionally, the maintenance/repair process can be complicated by a need for specialized tools and replacement parts.

BRIEF DESCRIPTION OF THE FIGURES

The present invention is illustrated by way of example and not limitation in the Figures of the accompanying drawings in which.

DESCRIPTION OF THE EMBODIMENTS

Methods and apparatus for servicing wagering game machines are described herein. This description of the embodiments is divided into five sections. The first section provides an introduction to embodiments of the invention. The second section describes example gaming device architectures, while the third section describes example operations performed by some embodiments of the gaming device architectures. The fourth section describes gaming machines and gaming network and the fifth section provides some general comments.

Introduction

This section introduces embodiments of the invention. In one embodiment, wagering game machines can electronically report varying types of service information to remotely located service controllers. The service controllers can analyze the service information along with service plans applicable to the wagering game machines. The service controllers can, based on the service information and service plans, take measures to repair/maintain the wagering game machines.

In one embodiment, the service controller can use general service information to determine that specific wagering game machine components need service. For example, the service information can indicate how many maximum bets were made in a given time period. If the number of maximum bets is uncharacteristically low, the service controller can determine that the "max bets" button needs service. The service controller can determine how to service the "max bets" button based on a service plan (e.g., a service contract) covering the wagering game machine. The following discussion of FIG. 1 shows one embodiment of such a system.

Figure 1:
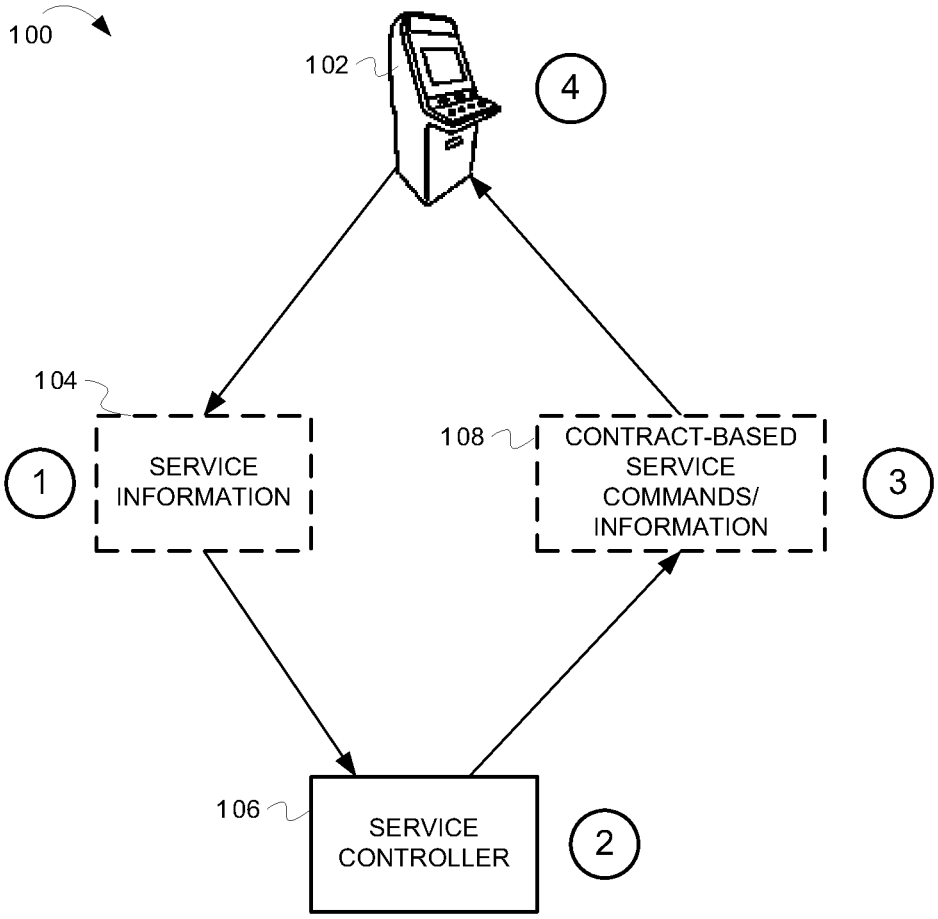
FIG. 1 is a dataflow diagram illustrating dataflow attendant to operations for remotely servicing wagering game machines, according to example embodiments of the invention.

FIG. 1 is a block diagram illustrating dataflow and operations for remotely servicing wagering game machines, according to example embodiments of the invention. As shown in FIG. 1, the wagering game network 100 includes a wagering game machine 102 and service controller 106.

The dataflow and operations may occur in four stages. At stage one, the wagering game machine 102 transmits service information 104 to the service controller 106. The service information 104 can include raw data or summaries describing how often the machine has been used, the machine's performance, fault information, and/or any other information relevant to ascertaining whether the wagering game machine 102 needs service.

At stage two, the service controller 106 analyzes the service information 104 based on a service agreement covering the wagering game machine 102. Using an electronic representation of the service agreement (not shown), the service controller 106 determines what service information and/or service commands it will send to the wagering game machine 102. The service commands can include instructions for resetting the wagering game machine 102 and/or its components, recalibrating components, testing components, etc. The service commands can include service information, which can include human-readable service notes, service manual text, machine-specific maintenance logs, or other information useful in servicing the machine.

At stage three, the service controller transmits the service commands 108 to the wagering game machine 102.

At stage four, the wagering game machine 102 performs the service commands and/or stores the service information. If additional services are needed, the wagering game machine 102 or the service controller 106 can inform technicians about what services have been performed and what services are needed. As a result, the service controller 106 can provide service, according to a service plan, to remotely located wagering game machines.

These and other features will be described in more detail below. The next section describes example wagering game machines in more detail.

Example Operating Environment

Example Wagering Game Machine Architecture

Figure 2:
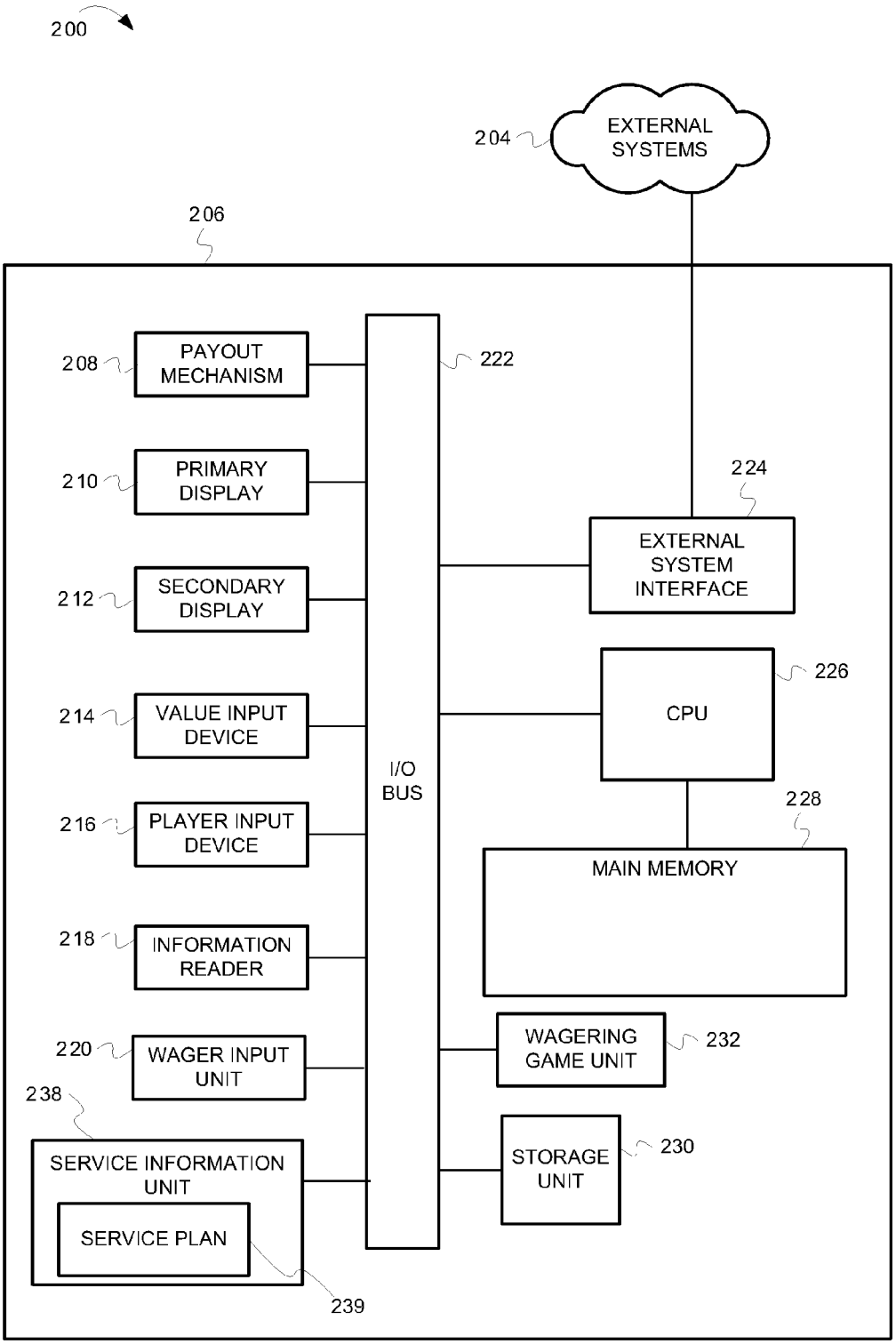
FIG. 2 is a block diagram illustrating a wagering game machine, according to example embodiments of the invention.

FIG. 2 is a block diagram illustrating a wagering game machine, according to example embodiments of the invention. As shown in FIG. 2, the wagering game machine 206 includes a central processing unit (CPU) 226 connected to main memory 228.

The CPU 226 is also connected to an input/output (I/O) bus 222, which facilitates communication between the wagering game machine's components. The I/O bus 222 is connected to a wagering game unit 232. In one embodiment, the wagering game unit 232 can receive wagers and conduct wagering games, such as video poker, video black jack, video slots, video lottery, etc. The I/O bus 222 is also connected to a service information unit 238, which includes an electronic service plan 239. In one embodiment, the service information unit 238 collects and analyzes service information and carries out service operations.

The I/O bus 222 is also connected to a payout mechanism 208, primary display 210, secondary display 212, value input device 214, player input device 216, information reader 218, storage unit 230, and service information unit 238, which includes a service plan 239. The I/O bus 222 is also connected to an external system interface 224, which is connected to external systems 204 (e.g., wagering game networks).

In one embodiment, the wagering game machine 206 can include additional peripheral devices and/or more than one of each component shown in FIG. 2. For example, in one embodiment, the wagering game machine 206 can include external system interfaces 224 and multiple CPUs 226. In one embodiment, any of the components can be integrated or subdivided. Additionally, the components of the wagering game machine 206 can be interconnected according to any suitable interconnection architecture (e.g., directly connected, hypercube, etc.).

In one embodiment, any of the components of the wagering game machine 206 (e.g., service information unit 238) can be embodied as hardware, firmware, and/or software for performing the operations described herein. For example, in an alternative to the embodiment shown in FIG. 2, the service information unit 238 can be software stored in the main memory 228 and executed by the CPU 226. Any of the wagering game machine's components can include machine-readable media including instructions for causing a machine to perform the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Figure 3:
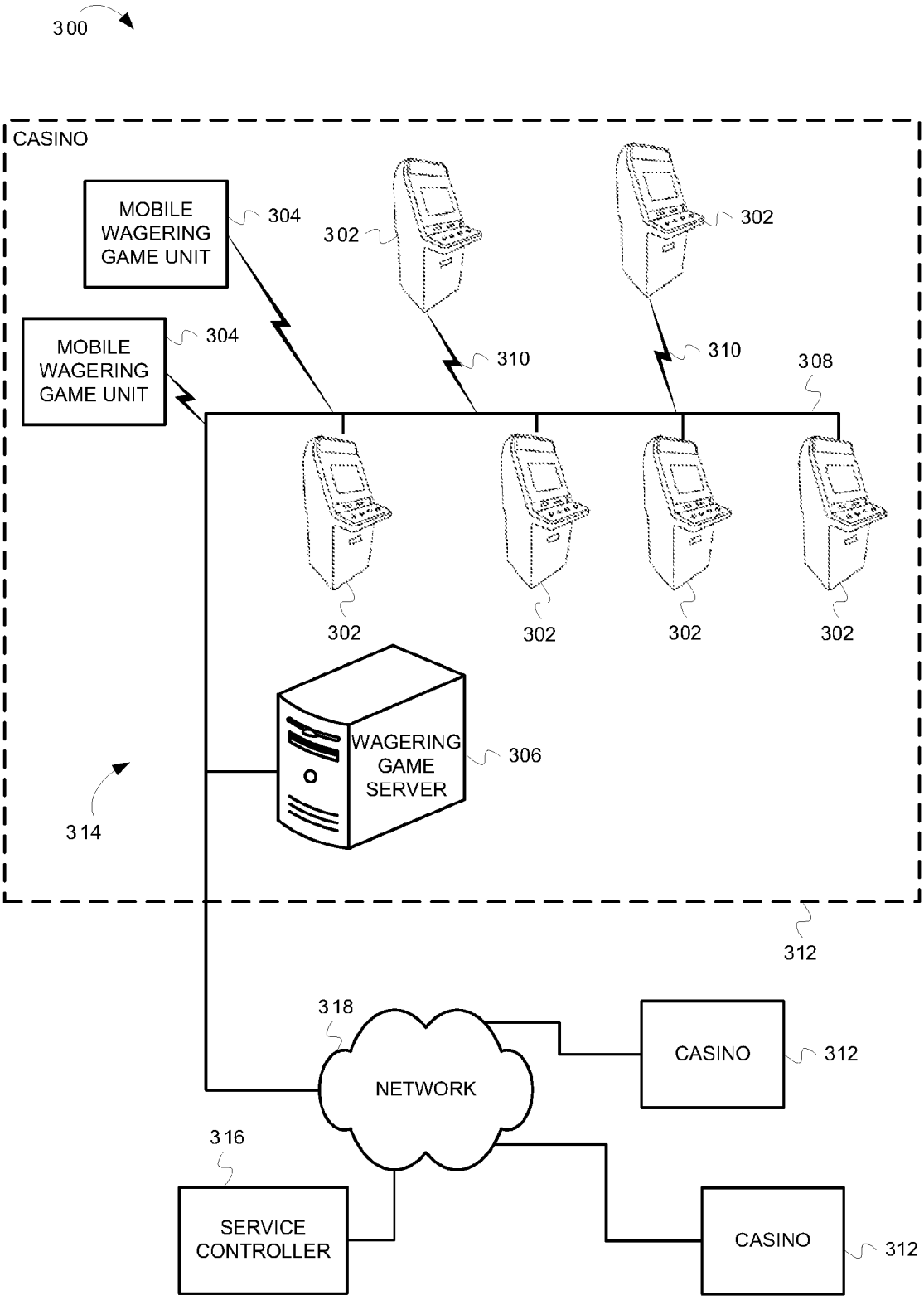
FIG. 3 is a block diagram illustrating a wagering game network, according to example embodiments of the invention.

While FIG. 2 describes example embodiments of a wagering game machine, FIG. 3 shows how a plurality of wagering game machines can be connected in a network.

Example Wagering Game Network

FIG. 3 is a block diagram illustrating a wagering game network, according to example embodiments of the invention. As shown in FIG. 3, the wagering game network 300 includes a plurality of casinos 312 and a service controller 316 connected to a communications network 318. Each of the plurality of casinos 312 includes a local area network 314, which includes a wagering game server 306, mobile wagering game units 304, and wagering game machines 302. Although not shown in FIG. 3, each casino 312 can include a service controller 316. In one embodiment, the wagering game server 306 serves wagering games and/or distributes wagering game content over the local area network 314. The wagering game server 306, mobile wagering game unit 304, and wagering game machines 302 can include hardware and machine-readable media including instructions for transmitting service-related information to the service controller 316. In one embodiment, the service controller 316 receives the service information and determines service actions based on the information and service plans applicable to the wagering game machines 302.

The service information can include information about any component of a wagering game machine 302 or mobile wagering game unit 304, such as a CPU 226, main memory 228, peripheral device, software program, etc. Additionally, the service information can include information about machines on the local area network 314, such as the wagering game server 306. For example, the service information can include information indicating component utilization, repair codes, failure information, component sensor readings (e.g., printer's print head temperature sensor, printer's paper tray sensor, etc.), etc. The service information can also include information about other wagering game machines 302 and/or mobile wagering game units 304 in the local area network 314. Additionally, the service information can include information about player inputs, player information, wagering game outcomes, or any other information that can be used in determining a wagering game machine's service status.

In one embodiment, the service controller 316 can use the service information to deduce that a machine is experiencing technical difficulties. For example, the service information may indicate that an unusually low number of $5 bills has been received by the value input device 214. Although, in this example, the service information does not include any data directly indicating a fault in the value input device 214, the service controller 316 can compare parameters in the service information to expected parameter values. If the values are outside of an acceptable range, the service controller 316 can take service actions prescribed in a service plan associated with the wagering game machine and/or the value input device 214. Embodiments of the service controller 316 can use the service information to deduce maintenance needs for any component of the wagering game machines 302, mobile wagering game unit 304, and wagering game server 306.

In one embodiment, the wagering game machines 302 can, alone or in concert with the service controller 316, detect hardware/software faults and isolate faulty components. After detecting faults, the wagering game machines 302 and/or service controller 316 can analyze the faults to determine what service actions may fix the faults. In one embodiment, the service controller 316 can remotely initiate services, whereas in another embodiment, the wagering game machines 302 initiate service operations on their own.

The wagering game machines described herein can take any suitable form, such as floor standing models, handheld mobile units, bartop models, workstation-type console models, etc. In one embodiment, the wagering game network 300 can include other network devices, such as accounting servers, wide area progressive servers, and/or other devices suitable for use in connection with embodiments of the invention.

The components of each casino 312 can communicate over wired 308 and/or wireless connections 310. Furthermore, they can employ any suitable connection technology, such as Bluetooth, the IEEE 802 communication protocol family, Ethernet, public switched telephone networks, SONET, etc.

While the discussion of FIGS. 2 and 3 describes wagering game machines and wagering game networks, the next section describes example operations performed by components of a wagering game network.

Operations

This section describes operations performed by embodiments of the invention. In the discussion below, the flow diagrams will be described with reference to the block diagrams presented above. In certain embodiments, the operations are performed by instructions residing on machine-readable media (e.g., software), while in other embodiments, the operations are performed by hardware and/or other logic.

Figure 4:
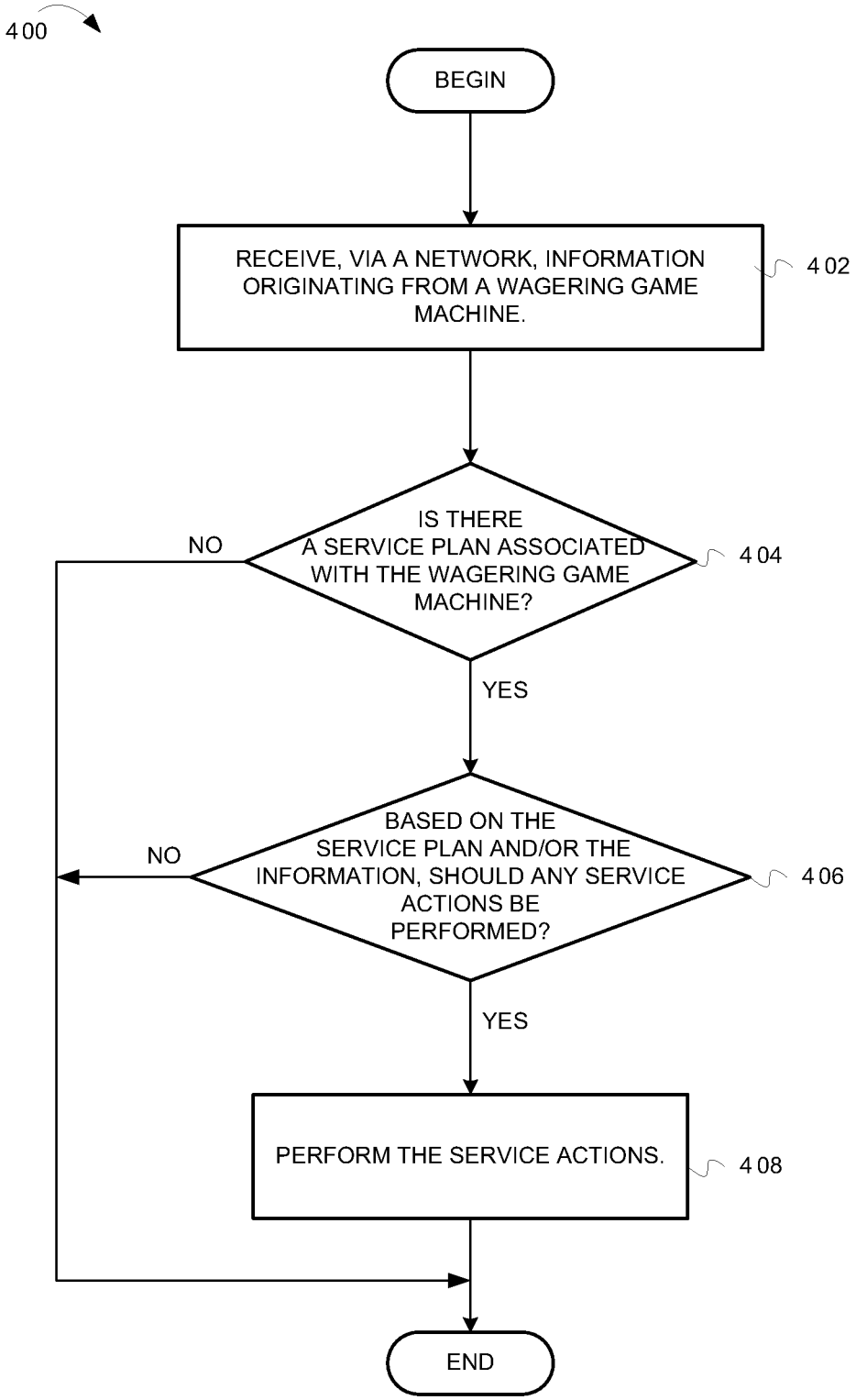
FIG. 4 is a flow diagram illustrating operations for receiving service information and performing service actions, according to example embodiments of the invention.
Figure 5:
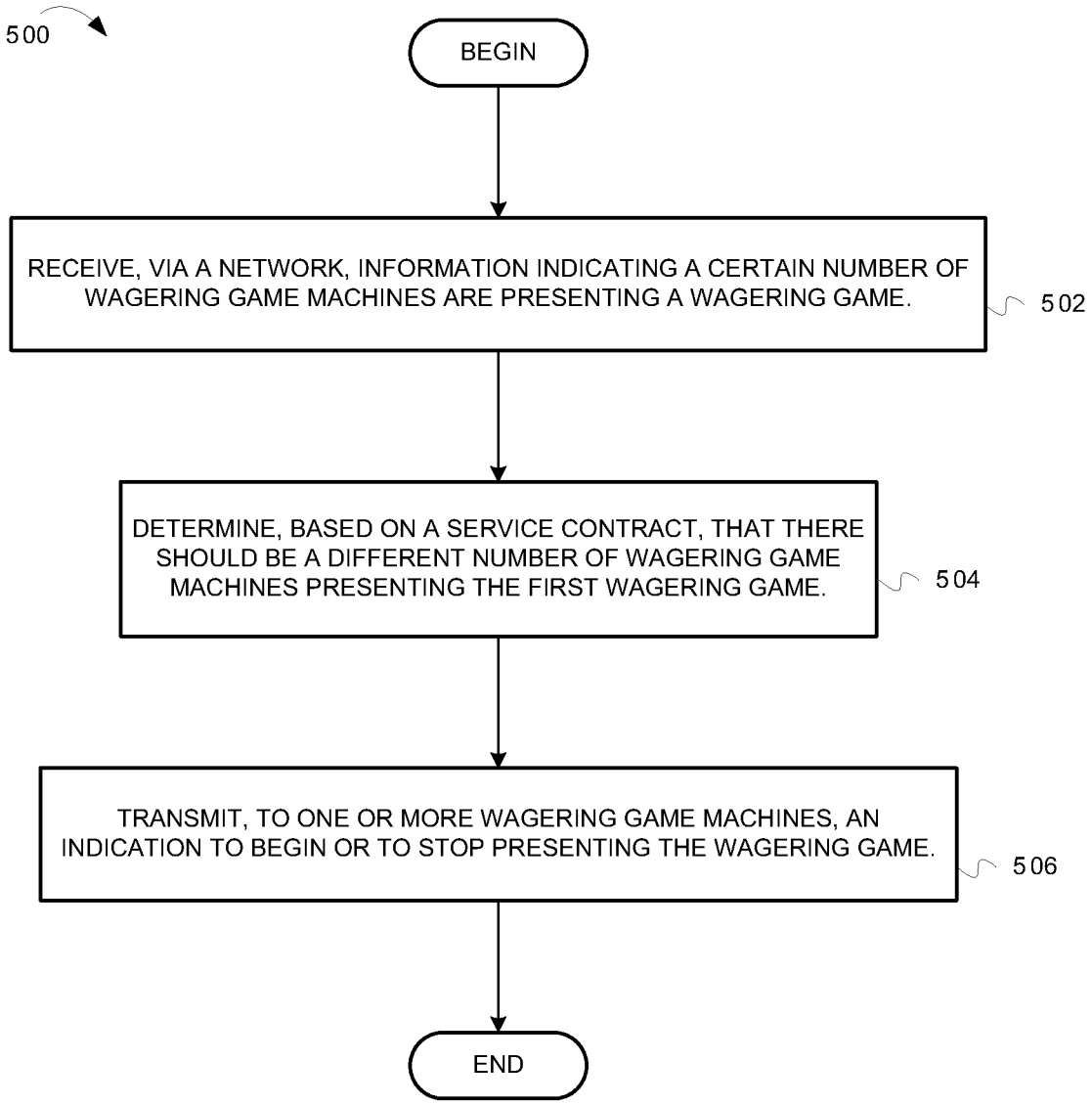
FIG. 5 is a flow diagram illustrating operations for instructing a wagering game machine to conduct a particular wagering game, according to example embodiments of the invention.

FIGS. 4-9 are discussed below. FIGS. 4 and 5 describe operations for receiving and processing service information, while FIGS. 6-9 describe operations for collecting and transmitting service information. This description will proceed with a discussion of FIG. 4.

FIG. 4 is a flow diagram illustrating operations for receiving service information and performing service actions, according to example embodiments of the invention. Flow diagram 400 commences at block 402.

At block 402, service information originating from a wagering game machine is received over a network. For example, the service controller 316 receives service information from a wagering game machine 302. The flow continues at block 404.

At block 404, a determination is made about whether there is a service plan associated with the wagering game machine. For example, service controller 316 determines whether there is a service plan associated with the wagering game machine 302. In one embodiment, the service controller 316 searches a database or other data store for a service plan associated with the wagering game machine 302. In one embodiment, the service plan enumerates services to be performed by the service controller 316. The service plan can be part of a service contract or other agreement between a wagering game machine operator and a service provider. If there is a service plan associated with the wagering game machine, the flow continues at block 406. Otherwise, the flow ends.

At block 406, a determination is made about whether service actions should be performed, where the determination is based on the service plan and the service information. For example, the service controller 316 determines, based on the service plan and information, whether to perform service actions. The service controller 316 can make the determination according to different criteria. In one embodiment, the service controller 316 can inspect the service information for indicia (e.g., service codes) explicitly indicating that particular services are needed by components of a wagering game machine 302. Alternatively, the service controller 316 can deduce, based on the service information, whether service actions should be taken (see discussion of FIG. 3). In one embodiment, the service controller 316 records and analyzes the service information. Such analysis can include comparing frequencies with which error messages are received from different wagering game machines 302. If the errors are occurring more frequently in some wagering game machines 302, the service controller 316 may determine that service actions are required for those wagering game machines 302. If service actions should be performed, the flow continues at block 408. Otherwise, the flow ends.

At block 408, the service actions are performed. For example, the service controller 316 performs service operations based on the service information and service plan associated with the wagering game machine 302. The service actions can include transmitting appropriate portions of a service manual to a wagering game machine 302, so technicians can use the service manual in servicing the wagering game machine 302. The actions can also include transmitting reboot commands, scheduling a wagering game machine for maintenance, communicating instructions to a technician, and remotely accessing any of a wagering game machine's addressable storage locations, such as locations in BIOS (not shown), main memory 228, storage unit 230, or any peripheral device. From block 408, the flow ends.

This description continues with FIG. 5, which describes additional service actions. In particular, FIG. 5 describes operations for ensuring that a particular wagering game is being presented on a predetermined number of wagering game machines. For example, the operations of FIG. 5 can be used to ensure that each casino 312 always (or almost always) has Jackpot Party® games running on at least three wagering game machines 302.

FIG. 5 is a flow diagram illustrating operations for instructing a wagering game machine to conduct a particular wagering game, according to example embodiments of the invention. The flow diagram 500 commences at block 502.

At block 502, information is received over a network, where the information indicates that a certain number of wagering game machines are presenting a particular wagering game. For example, the service controller 316 receives service information from the wagering game machines 302, where the service information indicate that three (or any other suitable number) of the wagering game machines 302 are presenting a particular wagering game, such as Jackpot Party® or Monopoly®-based slots. The number of wagering game machines 302 presenting the particular wagering game may fluctuate over time because of component failures or other service needs. The flow continues at block 504.

At block 504, a determination is made, based on a service plan, about how many wagering game machines should be presenting the particular wagering game. For example, the service controller 316 looks-up and inspects an electronic representation of a service plan associated with the wagering game machines 302. Based on the service plan, the service controller 316 determines how many (e.g., 3, 4, or any suitable number) wagering game machines 302 should be presenting the particular wagering game. The flow continues at block 506.

At block 506, an indication is transmitted to one or more wagering game machines, where the indication instructs the wagering game machine(s) to begin/cease presenting a particular wagering game. For example, the service controller 316 instructs a wagering game machine 302 to begin presenting a particular wagering game. In one embodiment, the indication causes the wagering game machine 302 to switch between different wagering games. For example, the wagering game machine may be presenting a Monopoly®-based slots game before switching to Jackpot Party®, as a result of an indication from the service controller 316. From block 506, the flow ends.

While the discussion of FIGS. 4 and 5 describes operations for processing service information and performing service actions, FIGS. 6-9 will describe operations collecting and transmitting service information and carrying-out service actions. This description will continue with FIG. 6.

Figure 6:
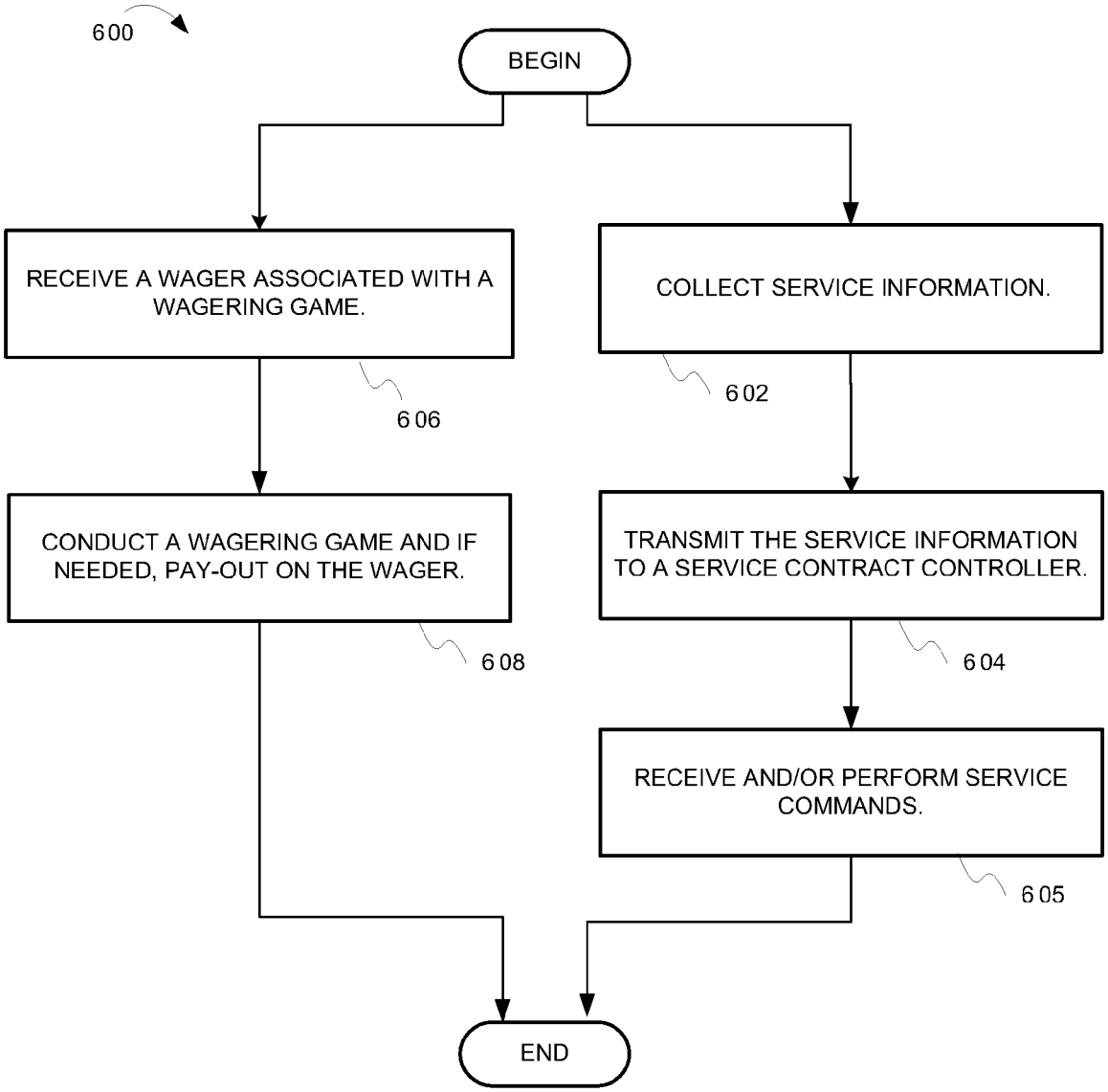
FIG. 6 is a flow diagram illustrating operations for transmitting service information, according to example embodiments of the invention.

FIG. 6 is a flow diagram illustrating operations for transmitting service information, according to example embodiments of the invention. The flow diagram 600 commences at blocks 602 and 606. In one embodiment, the operations of flow 600 can be performed in parallel. In another embodiment, the operations can be performed sequentially or in an interleaved fashion.

At block 602, service information is collected. For example, a wagering game machine's service information unit 238 collects service information. As noted above (see discussion of FIG. 3), the service information 238 can include any information that directly or indirectly indicates service states of a wagering game machine's components. In one embodiment, the service information unit 238 receives status information from one or more of the wagering game machine's peripheral devices (e.g., the ticket printer 216, payout mechanism 208, etc). The service information unit 238 can also collect service information about hardware and software that are not part of the wagering game machine's peripheral devices. For example, the service information unit 238 can receive service information from the wagering game machine's operating system (not shown), where the information indicates service states of a hard disk drive (not shown), expansion card (not shown), main memory 228, or other device. In one embodiment, the service information unit 238 can collect service information set forth in a service plan covering the wagering game machine 302. In one embodiment, a representation of the service plan is stored on the wagering game machine 302 (see service plan 239 of FIG. 2). The flow continues at block 604.

At block 604, the service information is transmitted to a service controller. For example, the wagering game machine 302 transmits the service information through the external interface 224 to the service controller 316. In one embodiment, the wagering game machine transmits the service information to the service controller 316 in response to the service controller's request (not shown) for the service information. In another embodiment, the wagering game machine 302 transmits the service information to a repository (not shown) accessible to the service controller 316. The flow continues at block 605.

At block 605, service commands are received and/or performed. For example, the service information unit 238 receives service commands from the service controller 316. The service information unit 238 can carry-out the service commands. In one embodiment, the service information unit 238 itself carries-out the service commands. In another embodiment, the service information unit 238 forwards the service commands to the CPU 226 for execution. As noted above, the commands can include reboot commands, reset commands, cycle commands, clear commands, and commands for accessing addressable memory locations and returning data to the service controller 316, etc. The service information unit 238 can perform the service commands immediately or it can wait until later (e.g., until after a wagering game is complete and all wagers are paid).

In one embodiment, the service information unit 238 does not receive service commands from the service controller 316. Instead, service information unit 238 itself analyzes the service information and performs service commands, such as "tilting" the wagering game machine 302 or disabling wagering game machine components. From block 605, the flow ends.

At block 606, a wager is received in association with a wagering game. For example, the wagering game machine 302 receives a wager through its player input device 216 value input device 214. The flow continues at block 608.

At block 608, the wagering game is conducted and, if needed, a wager is paid. For example, the wagering game machine's wagering game unit 232 conducts the wagering game (e.g., slots, video poker, video blackjack, etc.) and, if needed, pays-out the wager. From block 608, the flow ends.

Figure 7:
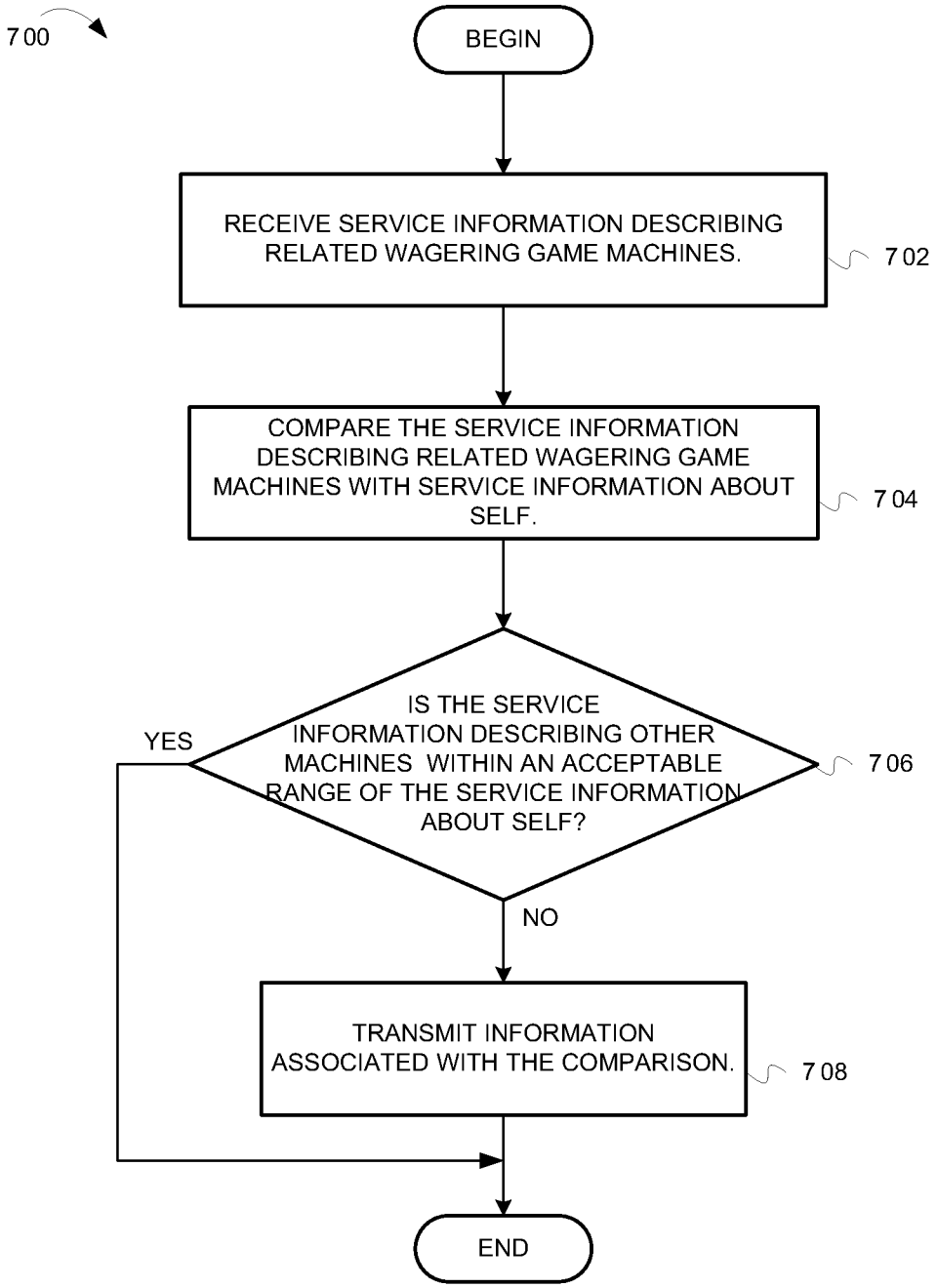
FIG. 7 is a flow diagram illustrating operations for collecting service information from other wagering game machines in a gaming network, according to example embodiments of the invention.

The description continues with FIG. 7, which describes how wagering game machines can collect service information from other wagering game machines in a gaming network.

FIG. 7 is a flow diagram illustrating operations for collecting service information from wagering game machines in a gaming network, according to example embodiments of the invention. The flow diagram 700 begins at block 702.

At block 702, service information about other wagering game machines is received. For example, a wagering game machine 302 receives service information from a neighboring wagering game machine. In one embodiment, the service information originates from and describes one or more wagering game machines in close spatial proximity to the wagering game machine 302. In one embodiment, the service information can describe wagering game machines that not in close spatial proximity, but that are related in some other way, such as having identical or similar game themes, components, configurations, operating times, etc. The flow continues at block 704.

At block 704, the service information about other wagering game machines is compared to service information about the machine performing flow 600. For example, the wagering game machine's service information unit 238 compares the service information describing other wagering game machines with the service information describing the wagering game machine 302. The flow continues at block 706.

At block 706, a determination is made about whether the other service information is within an acceptable range. For example, the service information unit 238 determines whether the service information describing the other machines is within an acceptable range of the service information describing the wagering game machine 302. If the service information is not with an acceptable range, the flow continues at block 708. Otherwise, the flow continues at block 708.

At block 708, information associated with the comparison is transmitted. For example, the service information unit 238 transmits information about the comparison to the service controller 316. In one embodiment, the information can include statistics indicating how far out of range the service information is. For example, the service information can indicate that temperatures are 30% higher than normal, particular buttons have been pressed with 50% higher frequently than normal, pay-outs have been 5% higher than normal, etc.

Although the operations of the flow 700 can be performed by embodiments of a wagering game machine, the service controller 316 can perform similar operations. For example, in one embodiment, the service controller 316 can compare service information collected from a set of wagering game machines with the service information of an individual wagering game machine. The service controller 316 can take service actions based on the comparisons. For example, if a wagering game machine received significantly fewer "max bets" than other machines in close spatial proximity, the service controller 316 could notify service technicians that the machine's "max bet" button may have failed or the service controller 316 could reposition the "max bet" button on the machine's configurable button panel.

Figure 8:
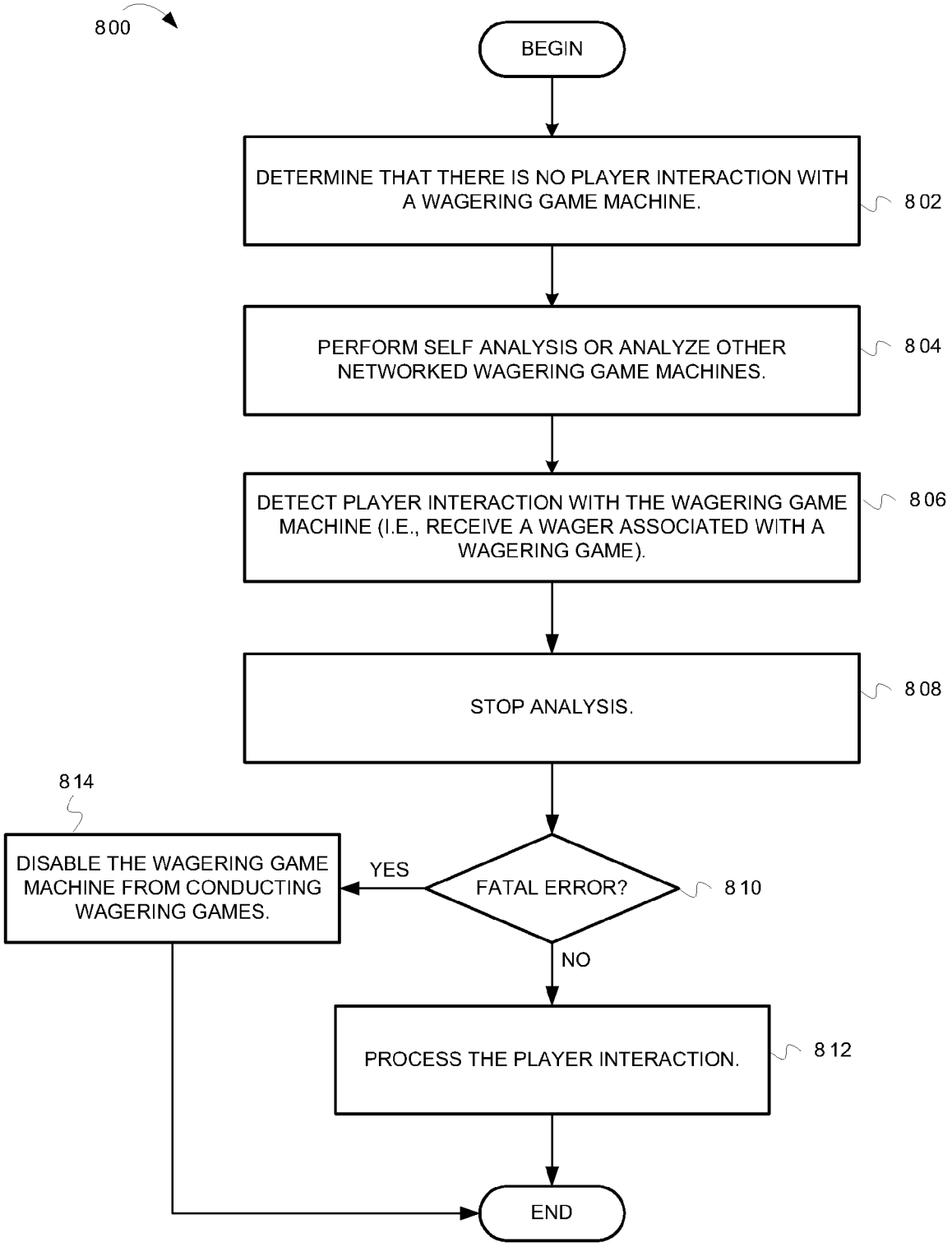
FIG. 8 is a flow diagram illustrating operations for scheduling a service analysis, according to example embodiments of the invention.

This description continues with FIG. 8.

FIG. 8 is a flow diagram illustrating operations for scheduling a service analysis, according to example embodiments of the invention. The flow diagram 800 begins at block 802.

At block 802, it is determined that there is no player interaction with a wagering game machine. For example, a wagering game machine's wagering game unit 232 determines that a player is not currently interacting with the wagering game machine 302. Player interaction can include inserting monetary value, activating input devices, playing a wagering game, etc. The flow continues at block 804.

At block 804, a self analysis is performed on service information. For example, the service information unit 238 analyzes its own service information or service information describing with other wagering game machines. The analysis can include statistically analyzing the service information to determine whether it falls within acceptable ranges, comparing service information between wagering game machines, etc. The analysis performed at block 804 can reveal component failures or indicate that components need specific services. The flow continues at block 806.

At block 806, player interaction is detected. For example, the wagering game unit 232 detects that a player is interacting with the wagering game machine 302. Player interaction can include receiving value (e.g., money or credit), pressing buttons to view wager gaming information, etc. The flow continues at block 808.

At block 808, the analysis is stopped. For example, the service information unit 238 stops analyzing service information. The flow continues at block 810.

At block 810, there is a determination about whether a fatal error has been discovered during the analysis. Fatal errors can include hardware and/or software faults, such as faults in Non-volatile Random Access Memory. If a fatal error has been discovered, the process continues at block 814. Otherwise, the flow 800 continues at block 812.

At block 812, the player interaction is processed. For example, the wagering game unit 232 processes a player interaction. In one embodiment, processing the player interaction can include receiving monetary or player input, such as button or touch screen input. Processing the player interaction can also include conducting a wagering game (e.g., video slots, video poker, etc.) based on the player input. The flow continues at block 812. From block 812, the flow ends.

At block 814, the wagering game machine is disabled from conducting wagering games. For example, the service information unit 238 disables the wagering game machine's wagering game unit 232 from conducting wagering games. Although the wagering game unit 232 will not conduct wagering games, it and/or the service information unit 238 may report additional service information to the service controller 316 and perform service commands received from the service controller 316. In one embodiment, after encountering a fatal error, the service information unit 238 informs the service controller 316 and/or presents an error message on the wagering game machine's primary display 210. From block 814, the flow ends.

Figure 9:
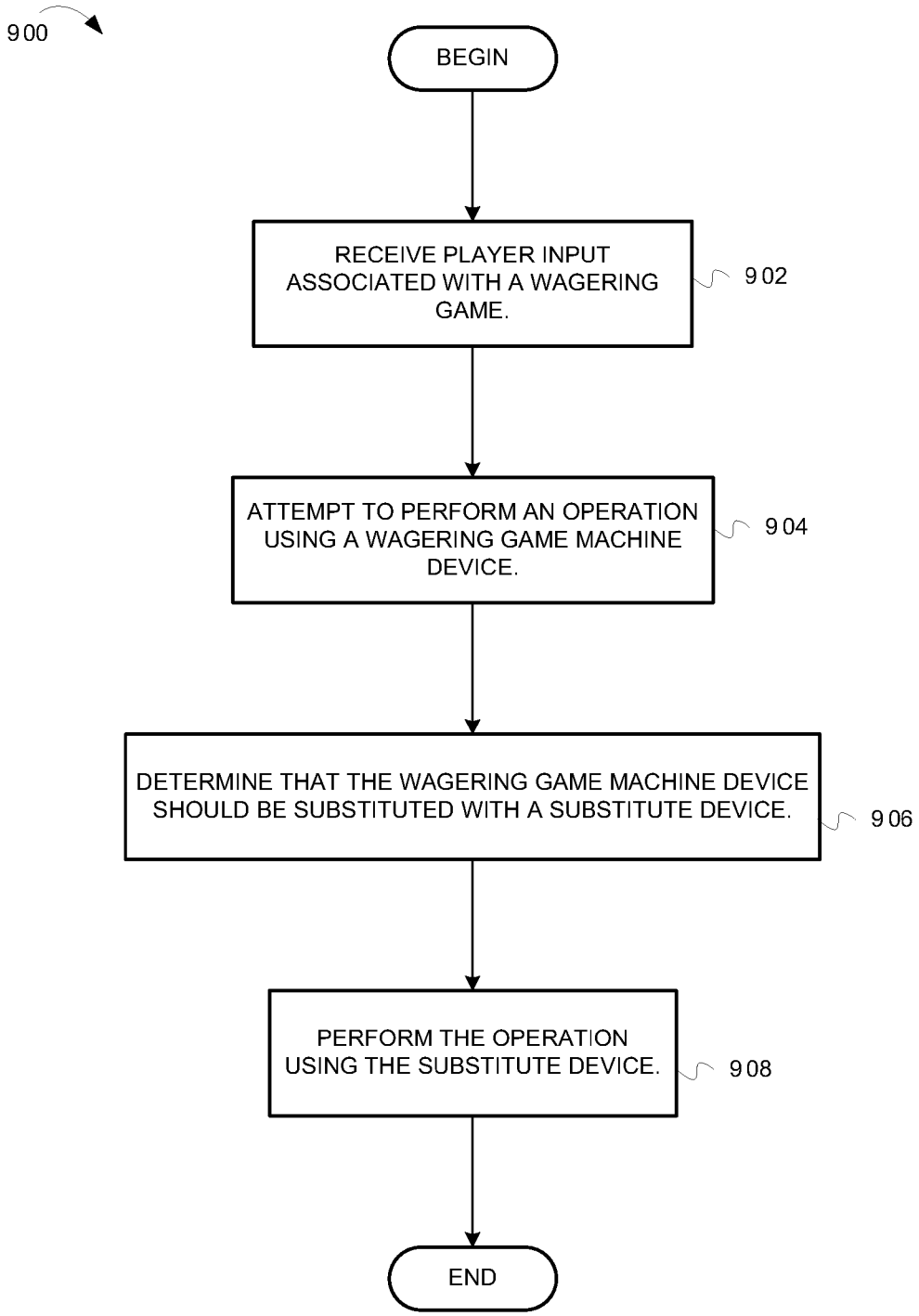
FIG. 9 is a flow diagram illustrating operations for performing wagering game operations using a substitute and wagering game machine device, according to example embodiments of the invention.

While FIG. 8 describes operations for scheduling service information analyses, this description continues with FIG. 9, which describes a failover technique that finds substitute components to perform wagering game operations.

FIG. 9 is a flow diagram illustrating operations for performing wagering game operations using a substitute wagering game machine device, according to example embodiments of the invention. The flow 900 commences at block 902.

At block 902, player input associated with a wagering game is received. For example, the wagering game unit 232 receives player input (e.g., a button press) through the player input device 216. The player input can include wagers, game selections, etc. The flow continues at block 904.

At block 904, an attempt is made to perform an operation using a wagering game machine device. For example, the wagering game unit 232 (or the wagering game machine's operating system) attempts to present a player input screen on the primary display 210. In one embodiment, the operation at block 904 occurs in response to the player input from block 902 or as a result of other operations occurring in the wagering game unit 232. The flow continues at block 906.

At block 906, a determination is made that the wagering game machine device should be substituted with a substitute device. For example, the wagering game unit 232 (or operating system) recognizes that the primary display 210 is exhibiting a fault and selects the secondary display 212 to operate as a substitute device. In one embodiment, the wagering game unit 232 can select any suitable device in the wagering game machine 302 to be the substitute device. In one embodiment, the wagering game unit 232 can select devices that are not part of the wagering game machine 302. For example, the wagering game unit 232 can select a processor in an adjacent sign controller (not shown) as a substitute for the CPU 226. Similarly, the wagering game machine 302 can select CPUs of idle wagering game machines in the network 314. The flow continues at block 908.

At block 908, the operation is performed using the substitute device. For example, the wagering game unit 232 presents the player input screen on the secondary display 212. As noted above, in one embodiment, the substitute device can be any device of the wagering game machine 302 or other network devices, such as other wagering game machines on the local-area network 314. From block 908, the flow ends.

Wagering Game Devices and Wagering Game Networks

This section describes addition details of wagering game machines in which embodiments of the invention can be practiced.

Example Wagering Game Machine

Figure 10:
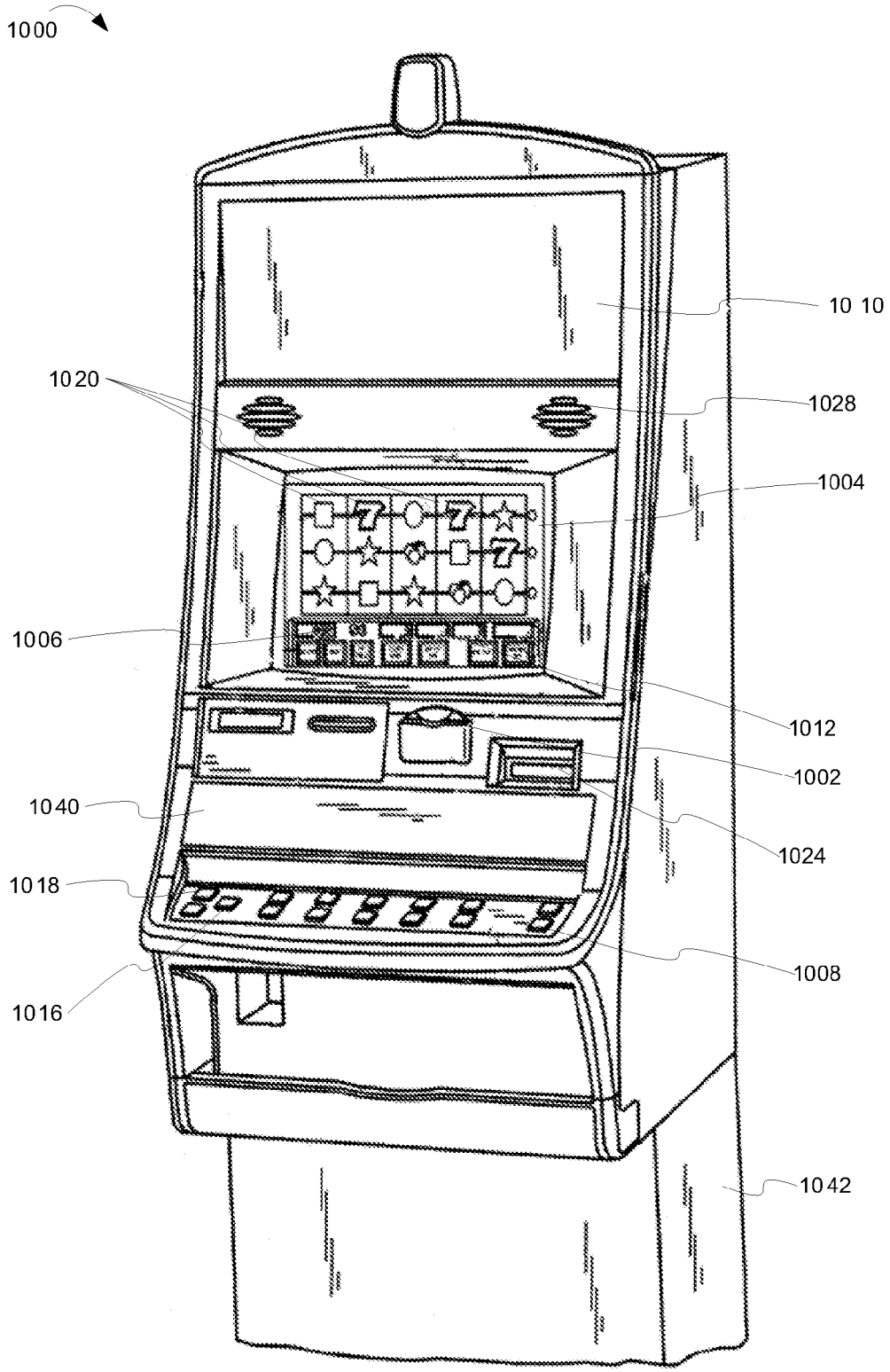
FIG. 10 is a perspective view of a wagering game machine, according to example embodiments of the invention.

FIG. 10 is a perspective view of a wagering game machine, according to example embodiments of the invention. As shown in FIG. 10, the wagering game machine 1000 can be a computerized slot machine having the controls, displays, and features of a conventional slot machine.

The wagering game machine 1000 can be mounted on a stand 1042 or it can be constructed as a pub-style tabletop game (not shown). As a result, the wagering game machine 1000 can be operated while players are standing or seated. Furthermore, the wagering game machine 1000 can be constructed with varying cabinet and display designs. The wagering game machine 1000 can incorporate any primary game such as slots, poker, or keno, and additional bonus round games. The symbols and indicia used on and in the wagering game machine 1000 can take mechanical, electrical, or video form.

As illustrated in FIG. 10, the wagering game machine 1000 includes a coin slot 1002 and bill acceptor 1024. Players can place coins in the coin slot 1002 and paper money or ticket vouchers in the bill acceptor 1024. Other devices can be used for accepting payment. For example, credit/debit card readers/validators can be used for accepting payment. Additionally, the wagering game machine 1000 can perform electronic funds transfers and financial transfers to procure monies from financial accounts. When a player inserts money in the wagering game machine 1000, a number of credits corresponding to the amount deposited are shown in a credit display 1006. After depositing the appropriate amount of money, a player can begin playing the game by pushing play button 1008. The play button 1008 can be any play activator used for starting a wagering game or sequence of events in the wagering game machine 1000.

As shown in FIG. 10, the wagering game machine 1000 also includes a bet display 1012 and one or more "bet" buttons on the panel 1016. The player can place a bet by pushing one or more of the bet buttons on the panel 1016. The player can increase the bet by one or more credits each time the player pushes a bet button. When the player pushes a "bet one" button 1016, the number of credits shown in the credit display 1006 decreases by one credit, while the number of credits shown in the bet display 1012 increases by one credit.

A player may end the gaming session or "cash-out" by pressing a cash-out button 1018. When a player cashes-out, the wagering game machine 1000 dispenses a voucher or currency corresponding to the number of remaining credits. The wagering game machine 1000 may employ other payout mechanisms such as credit slips (which are redeemable by a cashier) or electronically recordable cards (which track player credits), or electronic funds transfer.

The wagering game machine also includes a primary display unit 1004 and a secondary display unit 1010 (also known as a "top box"). The wagering game machine may also include an auxiliary video display 1040. In one embodiment, the primary display unit 1004 displays a plurality of video reels 1020. According to embodiments of the invention, the display units 1004 and 1010 can include any visual representation or exhibition, including moving physical objects (e.g., mechanical reels and wheels), dynamic lighting, and video images. In one embodiment, each reel 1020 includes a plurality of symbols such as bells, hearts, fruits, numbers, letters, bars or other images, which correspond to a theme associated with the wagering game machine 1000. Additionally, the wagering game machine 1000 also includes an audio presentation unit 1028. The audio presentation unit 1028 can include audio speakers or other suitable sound projection devices.

In one embodiment, the wagering game machine 1000 can transmit service information and perform operations described above.

General

In this description, numerous specific details are set forth. However, it is understood that embodiments of the invention may be practiced without these specific details. In other instances, well-known circuits, structures and techniques have not been shown in detail in order not to obscure the understanding of this description. Note that in this description, references to "one embodiment" or "an embodiment" mean that the feature being referred to is included in at least one embodiment of the invention. Further, separate references to "one embodiment" in this description do not necessarily refer to the same embodiment; however, neither are such embodiments mutually exclusive, unless so stated and except as will be readily apparent to those of ordinary skill in the art. Thus, the present invention can include any variety of combinations and/or integrations of the embodiments described herein. Each claim, as may be amended, constitutes an embodiment of the invention, incorporated by reference into the detailed description.

Herein, block diagrams illustrate example embodiments of the invention. Also herein, flow diagrams illustrate operations of the example embodiments of the invention. The operations of the flow diagrams are described with reference to the example embodiments shown in the block diagrams. However, it should be understood that the operations of the flow diagrams could be performed by embodiments of the invention other than those discussed with reference to the block diagrams, and embodiments discussed with references to the block diagrams could perform operations different than those discussed with reference to the flow diagrams. Additionally, some embodiments may not perform all the operations shown in a flow diagram. Moreover, although the flow diagrams depict serial operations, certain embodiments could perform certain of those operations in parallel.

The invention claimed is:

1. A wagering game machine, comprising:

a display unit configured to display a wagering game; and a service information unit configured to:

receive service information from one or more other wagering game machines, wherein the other wagering game machines are connected to the wagering game machine via a wagering game network;

perform a comparison between service information of the wagering game machine and the service information of the other wagering game machines to determine a service status for the other wagering game machines; and perform a service command based on the service status for the other wagering game machines.

2. The wagering game machine of claim 1, wherein the service information includes at least one parameter indicative of whether the wagering game machine needs service.

3. The wagering game machine of claim 1, wherein the service information includes one or more of: component information, usage information, player input patterns, repair notifications, service codes, or sensor readings.

4. The wagering game machine of claim 1, wherein performing the service command results in performance of one or more service actions for the other wagering game machines, the service actions including one or more of: transmitting reboot commands, transmitting service manual text, performing memory access commands, or scheduling maintenance.

5. The wagering game machine of claim 1, wherein performing the service command results in modifying the wagering game displayed on the wagering game machine.

6. The wagering game machine of claim 1, wherein performing the service command results in disabling the other wagering game machines or one or more components of the other wagering game machines.

7. The wagering game machine of claim 1, wherein the service command is based on the service information and a service plan.

8. The wagering game machine of claim 7, the service information unit further configured to determine whether a certain number of wagering game machines in the wagering game network are not presenting a particular wagering game of the other wagering game machines, wherein the certain number is defined by the service plan; and wherein responsive to determining the certain number are not presenting the particular wagering game, performing the service command results in the wagering game machine or another wagering game machine in the wagering game network to present the particular wagering game of the other wagering game machine.

9. The wagering game machine of claim 1, wherein the other wagering game machines are related to the wagering game machine based on spatial proximity within a group of wagering game machines.

10. The wagering game machine of claim 1, wherein the other wagering game machines are related to the wagering game machine based on similarity in game themes, components, configurations, or operating times.

11. The wagering game machine of claim 1, wherein the service information unit performs a determination whether the service information is within an acceptable range, and wherein performance of the service command based on the service status is responsive to the determination whether the service information is within the acceptable range.

12. A method performed by a wagering game machine, comprising:

receiving, over a wagering game network, service information of a related wagering game machine, the service information originating from the related wagering game machine, wherein the wagering game machine and the related wagering game machine are each configured to receive a wager associated with a respective wagering game;

determining, with a service information unit of the wagering game machine, a service status for the related wagering game machine based on the service information of the related wagering game machine, and a service action based on the service status for the related wagering game machine; and performing the service action.

13. The method of claim 12, wherein determining the service status includes comparing the service information originating from the related wagering game machine to service information originating from the wagering game machine.

14. The method of claim 12, wherein the service information includes information about one or more of components in the wagering game machine, usage of the wagering game machine, player input patterns, repair notifications, service codes, or sensor readings.

15. The method of claim 12, wherein the service information unit is further configured to receive additional service information describing another wagering game machine in the wagering game network, and compare the additional service information to the service information.

16. The method of claim 12, wherein performing the service action comprises providing to the related wagering game machine one or more of: a reboot command, service manual text, memory access commands, or a command related to scheduling the wagering game machine for service.

17. The method of claim 12, wherein performing the service action comprises transmitting one or both of the service information and service status to a service controller in the wagering game network, the service controller configured for determining one or more service commands to send to the related wagering game machine.

18. The method of claim 12, wherein performing the service action comprises modifying presentation of a wagering game on the wagering game machine in response to the service status for the related wagering game machine.

19. The method of claim 12, further comprising enabling for subsequent gaming operations, in connection with the service action, a wagering gaming device in the wagering game machine or the related wagering game machine.

20. The method of claim 12, wherein the related wagering game machine is related based on one or more of: proximity to the wagering game machine, or similarity in game themes, components, configurations, or operating times.

21. A non-transitory machine-readable storage device including instructions which when executed by a particular wagering game machine cause the particular wagering game machine to perform operations comprising:

presenting a wagering game on which monetary value is wagered;

collecting service information from a related wagering game machine, wherein the particular wagering game machine is connected to the related wagering game machine via a wagering game network;

processing the service information with a service controller to determine one or more service commands; and executing the service commands.

22. The non-transitory machine-readable storage device of claim 21, wherein the related wagering game machine is related based on one or more of: proximity to the wagering game machine, or similarity in game themes, components, configurations, or operating times.

23. The non-transitory machine-readable storage device of claim 21, wherein processing the service information with a service controller to determine service commands comprises comparing the service information from the related wagering game machine to service information from the particular wagering game machine.

24. The non-transitory machine-readable storage device of claim 21, wherein executing the service commands results in the performance of one or more service actions on the particular wagering game machine.

25. The non-transitory machine-readable storage device of claim 21, wherein executing the service commands results in the performance of one or more service actions on the one or both of the related wagering game machine and other wagering game machines connected to the wagering game network.

26. A wagering game machine, comprising:

a processor;

a machine-readable storage device including instructions which, when executed by the processor, cause the wagering game machine to:

receive at least one parameter from one or more other wagering game machines, the at least one parameter indicative of operations in the other wagering game machines, wherein the other wagering game machines are connected to the wagering game system via a wagering game network;

perform an analysis of the at least one parameter to determine a service status for the other wagering game machines, and perform a service command based on the service status for the other wagering game machines.

* * * * *